US007275707B2

(12) United States Patent
Brandli et al.

(10) Patent No.: US 7,275,707 B2
(45) Date of Patent: Oct. 2, 2007

(54) CONVEYING SYSTEM FOR FEEDING PAPER REELS TO REEL STANDS AND METHOD FOR OPERATING THE SAME

(75) Inventors: Walter Brandli, Laufen (CH); Hugo Allemann, Bellmund (CH); Hans Frey, Breitenbach (CH); Jean-Jacques Perinat, Courrendlin (CH)

(73) Assignee: Metso Paper AG, Delemont (CH)

( * ) Notice: Subject to any disclaimer, the term of this patent is extended or adjusted under 35 U.S.C. 154(b) by 320 days.

(21) Appl. No.: 10/870,920

(22) Filed: Jun. 21, 2004

(65) Prior Publication Data

US 2005/0023408 A1 Feb. 3, 2005

(30) Foreign Application Priority Data

Jun. 26, 2003 (EP) ..... 03405468

(51) Int. Cl.
*B65H 67/00* (2006.01)

(52) U.S. Cl. ..... 242/559; 242/561

(58) Field of Classification Search ..... 242/558, 242/559, 561
See application file for complete search history.

(56) References Cited

U.S. PATENT DOCUMENTS 4,386,741 A * 6/1983 Weiss et al. ..... 242/559.3
4,458,851 A * 7/1984 Tokuno et al. ..... 242/559
4,586,673 A * 5/1986 Tokuno et al. ..... 242/559.3
5,762,283 A * 6/1998 Buchmeyer et al. ..... 242/532.3

FOREIGN PATENT DOCUMENTS

| | | | |
|---|---|---|---|
| DE | 43 44 743 A | | 6/1995 |
| DE | 196 11 494 A | | 9/1997 |
| DE | 198 60 475 A | | 7/2000 |
| JP | 55123837 A | * | 9/1980 |
| SE | WO94/03385 | * | 2/1994 |
| WO | WO 03/080488 A | | 10/2003 |

* cited by examiner

*Primary Examiner*—Gene O. Crawford
*Assistant Examiner*—Sang Kim
(74) *Attorney, Agent, or Firm*—Oliff & Berridge, PLC

(57) ABSTRACT

For reel core disposal from a reel stand (1) of a row of reel stands, a conveyor belt (21) running along said row is arranged on the removal side opposite the feed side, in a trench (20), to which conveyor belt a transfer track (16) leads from each reel stand (1). A reel core carriage (25) which can travel on said transfer track and on a track section (11) of a moving platform (10) of the reel stand (1) has a chassis (26) and, as a reel core holder, a trough (29) rotatably and tiltably mounted on said chassis. An unloading device for rotating the trough (29) through 90° into an orientation parallel with the conveyor belt (21) and back and for tilting thereof is arranged in a stationary manner at a delivery point (18) at the end of the transfer track (16). After picking up a reel core (17) at the reel stand (1) with trough (29) aligned parallel to the unwinding axes (9) of said stand, the reel core carriage (25) travels to the delivery point (18), where the trough (29) is rotated and, after a cover (22) has been swivelled up, is tilted so that the reel core (17) rolls onto the conveyor belt (21) and is conveyed along the row of reel stands to a reel core container and is disposed of.

25 Claims, 18 Drawing Sheets

CONVEYING SYSTEM FOR FEEDING PAPER REELS TO REEL STANDS AND METHOD FOR OPERATING THE SAME

FIELD OF THE INVENTION

The invention relates to a conveying system for supplying a plurality of reel stands arranged in a row with paper reels. Such systems are used in reel cellars of printing works.

PRIOR ART

The paper reels used in printing works, especially newspaper printing works, each contain a cardboard reel core on which the paper web is wound. Once a paper reel has been consumed, the reel core wound with a residue of the paper web remains over and is then ejected from the reel stand. The reel cores must be removed from the region of the reel stands and collected in a reel core container, by means of which they are conveyed away, for example at the end of printing.

There are many possibilities for disposing of reel cores from the reel stand region, all of which, however, have certain disadvantages. In many cases, additional conveying means which serve only for disposing of the reel cores are provided. However, the known solutions of this type generally require a great deal of space and, in certain circumstances, impair the safety of the personnel.

According to DE 36 27 454 A1 of the generic type, for example, a further removal track is provided on that side of the row of reel stands which faces away from the feed side and parallel to said row, to which transfer tracks which are connected to the removal track via turntables lead from the reel stands. The reel cores are conveyed away via these tracks in each case individually by conveying carriages. A similar description appears in DE 198 60 475 A1 of the generic type, where, however, reel core carriages which are suitable in each case for holding a relatively large number of reel cores travel on the transfer tracks and the removal track. In both cases, the space requirement is considerable and particularly the region in which the risk is increased owing to the vehicles travelling there and which therefore should as far as possible not be entered for safety reasons is large. The reel core holder of the reel core carriage is not tiltable so that it is not suitable for combined use with other conveying means and additional means are required for unloading it, unless this is effected manually. Moreover, the reel cores carriage is not suitable for aligning the reel core in a direction other than the longitudinal direction of the reel core carriage, which limits the possible methods of use.

According to DE 42 15 739 A1, a gripper is provided which is guided along a rail suspended below the ceiling and picks up the reel core in each case from a trough arranged alongside a track section on a moving platform at the reel stand and conveys it to a reel core container. This solution is fairly complicated and is not directly suitable for relatively large systems having a row of reel stands.

JP 62 157 160 A describes a separate roller conveyor for reel core disposal which leads away from the reel stand in the axial direction. This solution is not suitable for disposing of reel cores from a relatively large system comprising a row of reel stands.

It is also known that reel cores can be removed along substantially the same routes along which delivery of the paper reels is effected, but this is logistically unfavourable because mutual hindrance of the paper reel delivery and the reel core disposal easily occurs. In particular, the paper reel delivered and the reel core to be disposed of almost inevitably intersect somewhere, which requires relatively complicated solutions.

Thus, it is disclosed, for example in DE 196 37 771 A1, that it is possible to provide, for travel along a supply track parallel to the row of reel stands, a transverse conveying carriage which carries two transverse tracks, one of which can hold a conveying carriage loaded with a paper reel and the other a conveying carriage loaded with a reel core or residual reel. JP 04 164 760 A discloses the provision of the moving platform at the reel stand with a tiltable holder for the reel core, onto which the reel core is ejected and from which it is thrown onto the conveying carriage which has become free after the delivered paper reel has been lifted off in the reel stand.

SUMMARY OF THE INVENTION

It is the object of the invention to provide a conveying system of the generic type in which the reel core disposal is achieved in a space-saving manner so that it does not hinder the paper reel feed. The solution should be suitable in particular for large systems.

In the conveying system according to the invention, the part serving for reel core disposal is virtually completely separated from that part of the conveying system which serves for paper reel feed. The disposal part can be realized in a small space and in particular requires scarcely any additional space above-ground, so that the region which is problematic with regard to safety is increased by it only slightly or even not at all. It also has a relatively simple design and is economical, simply because, in contrast to the known solutions of the generic type, components which are dimensioned for heavy paper reels are not used for conveying the light reel cores.

BRIEF DESCRIPTION OF THE DRAWINGS

The invention is explained in more detail below with reference to figures which merely represent embodiments.

DESCRIPTION OF THE PREFERRED EMBODIMENTS

Figure 1:
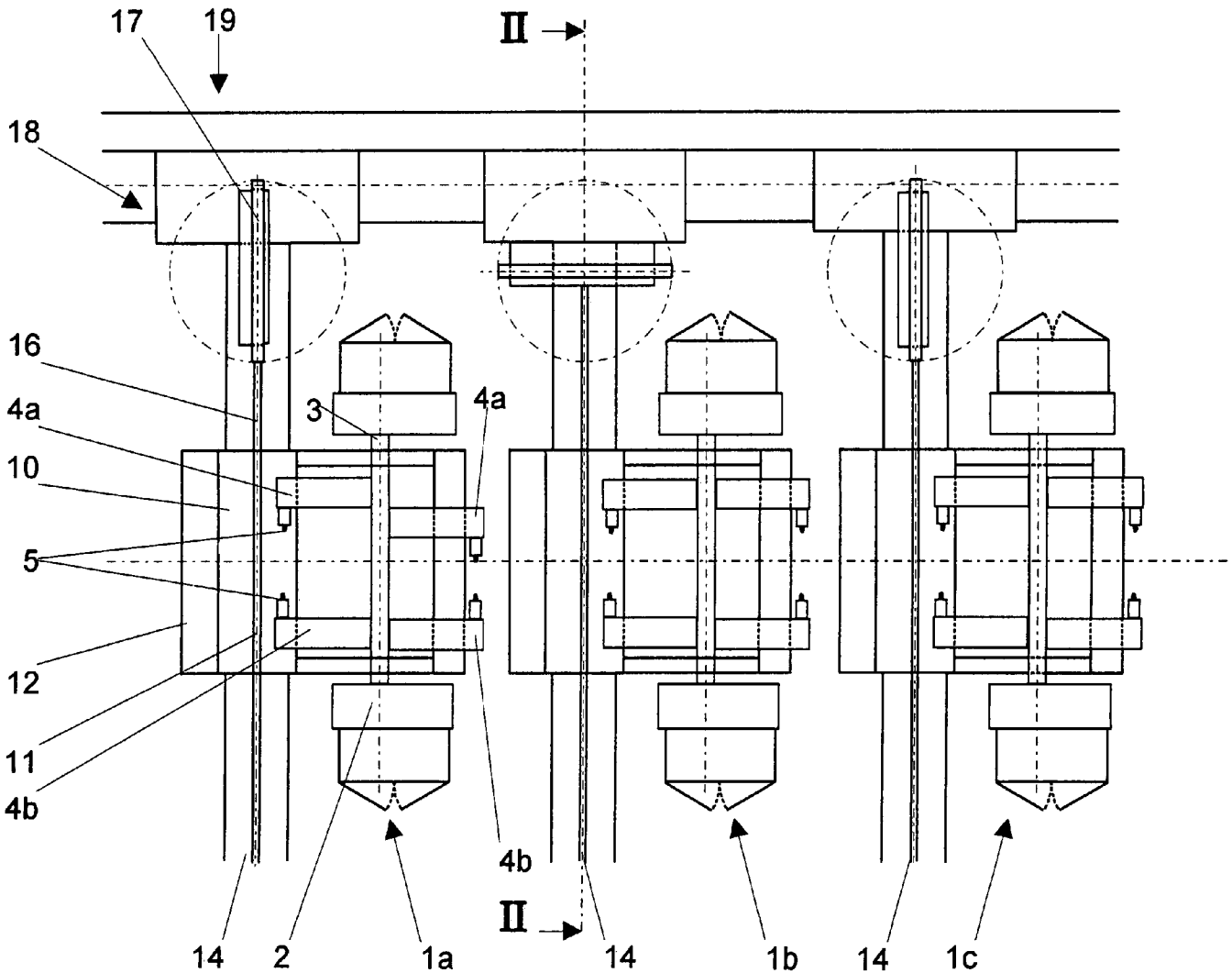
FIG. 1 schematically shows a plan view of a section of a row of reel stands with conveying system according to the invention, according to a first embodiment.

A reel cellar of a printing works has a plurality of reel stands which are arranged in a row. Three of these reel stands 1*a,b,c* are shown in FIG. 1. Each reel stand 1*a,b,c*—reel stand 1 (FIG. 2) is described below as an example of one of these—comprises a portal 2 in which an axle 3 is rotatably mounted, which axle has two arms 4*a,b* which are opposite one another and a distance apart, are displaceable to a limited extent along the axle 3 and at whose ends cones 5 are rotatably mounted on the insides. In each case a reel core of a paper reel 6 on which a paper web 7 is wound can be clamped between the opposite cones 5 of the arms 4*a,b*. The paper web 7 is unwound and is drawn upwards over a guide roller 8, while the paper reel 6 rotates about an unwinding axis 9 passing through the cones 5 and parallel to the axle 3. The two unwinding axes 9 of each reel stand are thus aligned normal to the row of reel stands.

A moving platform 10 having a track section 11 which is parallel to the unwinding axes 9 and is displaceable along a pit 12 transverse to the unwinding axes 9 is coordinated with the reel stand 1. The pit 12 lies for the greater part under the reel stand 1 but extends beyond said reel stand on one side. Three light barriers 13 each are arranged one on top of the other on the outside of the portal 2 of the reel stand 1, on both sides, as part of access security, of which the lower light barrier is located 40 cm above the floor, the middle one 90 cm above the floor and the upper one above the floor by slightly more than the largest reel diameter.

Figure 2:
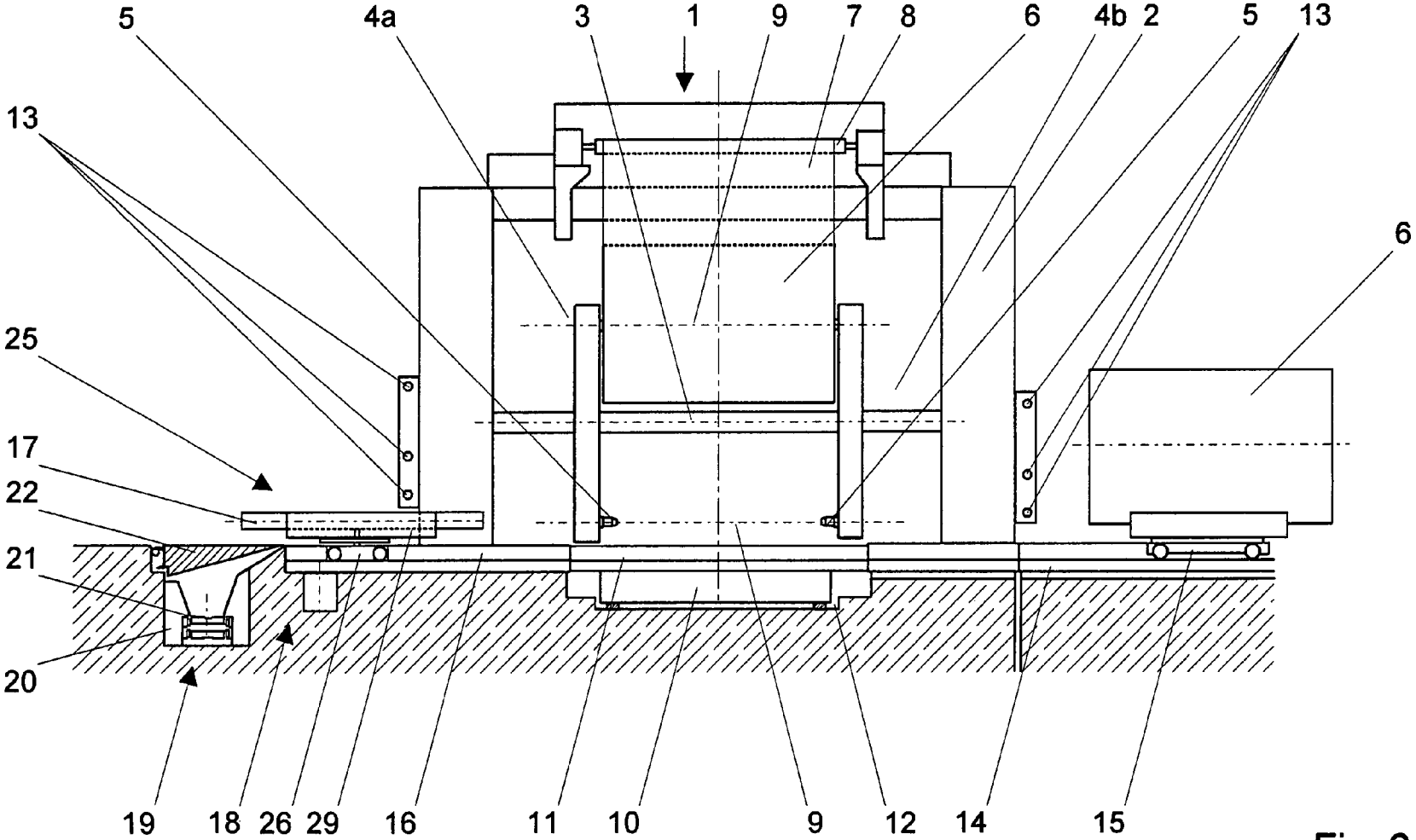
FIG. 2 shows a cross-section along II-II in FIG. 1.

A conveying system is provided for supplying the reel stands of the row with paper reels 6 and for disposing of the reel core remaining in each case after unwinding of the paper web 7. Said conveying system comprises a feed means which is arranged on the feed side of the row of reel stands, serves for feeding paper reels and has in each case a loading track 14 leading to the reel stand 1, and a conveying carriage 15. The loading track 14 is in each case parallel to the unwinding axes 9 of the reel stand 1 and leads up to the lateral edge of the pit 12. If, as shown in FIGS. 1, 2, the moving platform 10 is in a pick-up position, the track section 11 is flush with the loading track 14. The conveying system may furthermore comprise a feed track (not shown) which is arranged parallel to the row of reel stands and from which the loading tracks 14, connected to it, for example, via turntables, emanate. Conveying carriages 15 travel on the feed track and the loading tracks 14. However, it is also possible to arrange a high-bay store parallel to the row of reel stands. In this case, the loading tracks 14 lead to transfer points where the conveying carriage 15 can accept paper reels from a shelf control unit.

In addition, the conveying system comprises a disposal means arranged on the opposite removal side of the row of reel stands and intended for disposing of reel cores 17. A transfer means is coordinated with each reel stand 1. According to a first embodiment of the conveying system, it has a transfer track 16 which leads from the edge of the pit 12 to a delivery point 18, and conveying means 19 running close to and past the delivery points 18 along the row of reel stands. The transfer track 16 is flush with the track section 11 when the moving platform 10 is in the transfer position. In the conveying system shown, the loading track 14 is in each case flush with the transfer track 16 so that the pick-up position and the transfer position of the moving platform 10 correspond in each case.

The conveying means 19 comprises a conveyor belt 21 arranged along the row of reel stands in a trench 20, or a row of such conveyor belts adjacent to one another. The trench 20 is covered by cover plates arranged level with the floor, so that it does not represent an obstacle to walking and travelling in the region. At the delivery points 18, it has in each case a cover 22 which can be swivelled open and closed by means of a drive, for example of an electric motor, and whose length is slightly greater than the maximum expected length of a reel core 17. It is usually closed, so that its surface is likewise level with the floor, but may be swivelled up for providing access to the conveying means 19.

Figure 3:
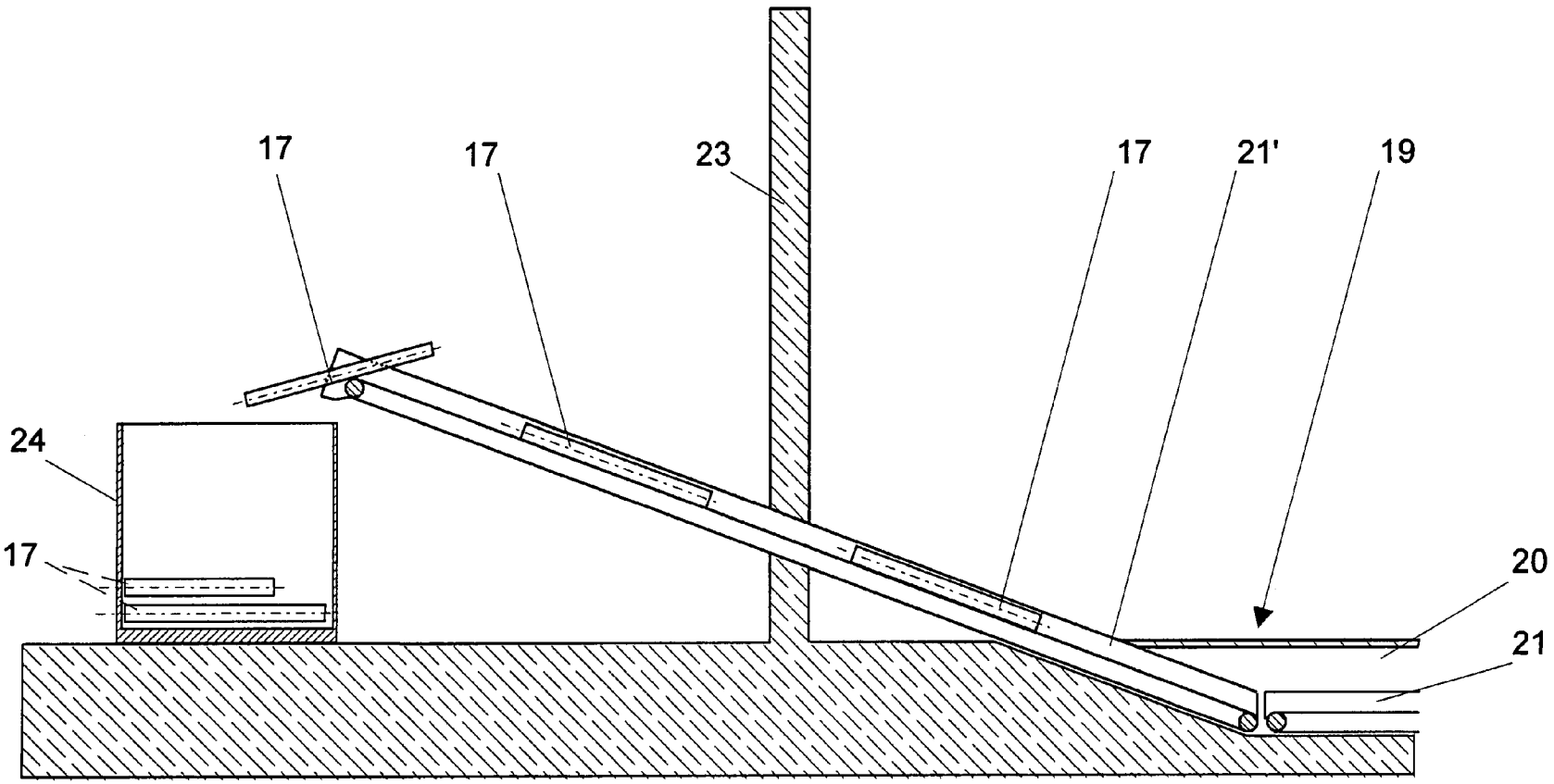
FIG. 3 shows a longitudinal section through a part of a conveying means of the conveying system according to the invention.

The conveying means 19 has (FIG. 3), at the end of the row of reel stands, an end section, a conveyor belt 21' which ascends from the trench 20 above floor level through a wall 23 into an anteroom in which it projects above the edge of a reel core container 24 which is open at the top and is in the form of an roller container of about 40 $m^3$.

A reel core carriage 25 travels on the transfer track 16 and the track section 11. It has (FIG. 4*a-c*) a chassis 26 with a narrow baseplate 27 whose top is at floor level and on whose underside wheels 28 which run on the transfer track 16 are mounted. An elongated trough 29 is tiltably mounted as a reel core holder on a base 30, which in turn is mounted in the baseplate 27 so as to be rotatable about a vertical axis. For this purpose, the base 30 has a carrier 31 which is provided on the underside with support rollers 32 running on a plate 33 supported on the baseplate 27, and to which the trough 29 is connected by hinges 34. Formed on the underside of the carrier 31 is a vertical axle 35 which penetrates the plate 33 and the baseplate 27 and is rotatably mounted in the latter and which is connected via a lever 36 to an eccentrically mounted, downward-projecting finger 37 which, at its end, carries an engaging roller rotatable about a vertical axis. The total height of the loaded reel core carriage 25 is just less than 40 cm so that, even when it is loaded with a reel core, it does not trigger the lower light barrier of the light barriers 13, and it is possible to dispense with a complicated deactivation of the access security on passage of the reel core carriage 25.

A buffer 38 which limits the travel of the reel core carriage 25 and defines its position at the delivery point 18 is anchored as a stop at the end of the transfer track 16. Before the buffer 38, an unloading device having a rotary device 40 is arranged under the transfer track 16 in a pit 39. Said unloading device comprises a motor 41 which is connected via a mitre gear 42, which is simultaneously in the form of a reducing gear, to a drive lever 43 which is mounted, so as to be rotatable about a vertical axis, in a bearing fastened in the pit 39. The drive lever 43 has a longitudinal groove 44 which is engaged by the finger 37 with the engaging roller so that the carrier 31 of the reel core carriage 25 can be rotated with the trough 29 by means of the drive lever 43.

One side of the trough 29 rests (FIG. 4*b*) on a support 45 which is mounted on the carrier 31 and serves as a stop and towards which it is pulled by a tension spring 46 so that it is held, without external action, in an upright position which is determined by the support 45 and in which a reel core placed in it remains lying on its bottom. For tilting and emptying the trough 29, the unloading device (FIG. 4*c*) has a tilting device 47 which is installed next to the transfer track 16 and has a ram 48 which is extendable obliquely from below towards the trough 29 and is displaceably mounted next to the transfer track 16 in a stationary longitudinal guide 49 in the pit 39. The ram 48 may be in the form of a piston of a remote-controllable pneumatic cylinder. Its tip is covered with low-friction material. The orifice through which it is extended is covered by a hinged cover 50 which is level with the floor in the closed state.

For disposal of a reel core 17 from the reel stand 1, the moving platform 10 is moved into the transfer position, after which the reel core carriage 25 parked on the transfer track 16, for example at the delivery point 18, travels onto the rail section 11 of the moving platform 10. This is then moved until the trough 29 is below the reel core, i.e. below the unwinding axis 9 defined by the cones 5 which hold the reel core. The trough 29 as the reel core holder is in the pick-up position with longitudinal direction parallel to the unwinding axes 9. Thereafter, the arms 4*a*, 4*b* are pulled apart and at the same time the reel core is pushed off the cones 5 by scrapers so that it falls into the trough 29.

Figure 4A:
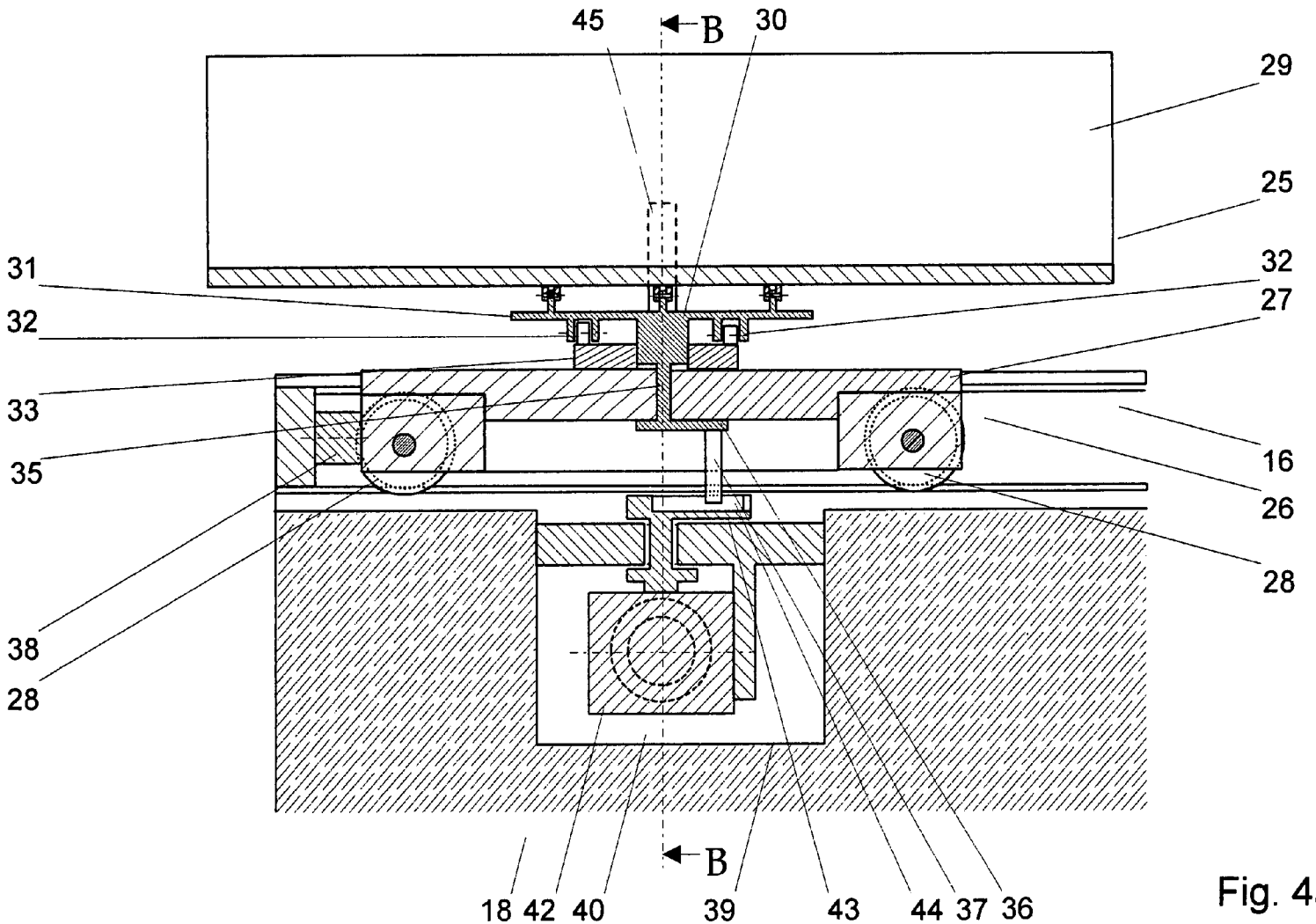
FIG. 4*a* shows a longitudinal section through a section of a transfer track of the conveying system according to the invention and of a reel core carriage having a reel core holder in a receiving position, according to a section along A-A in FIG. 4*b*.
Figure 4B:
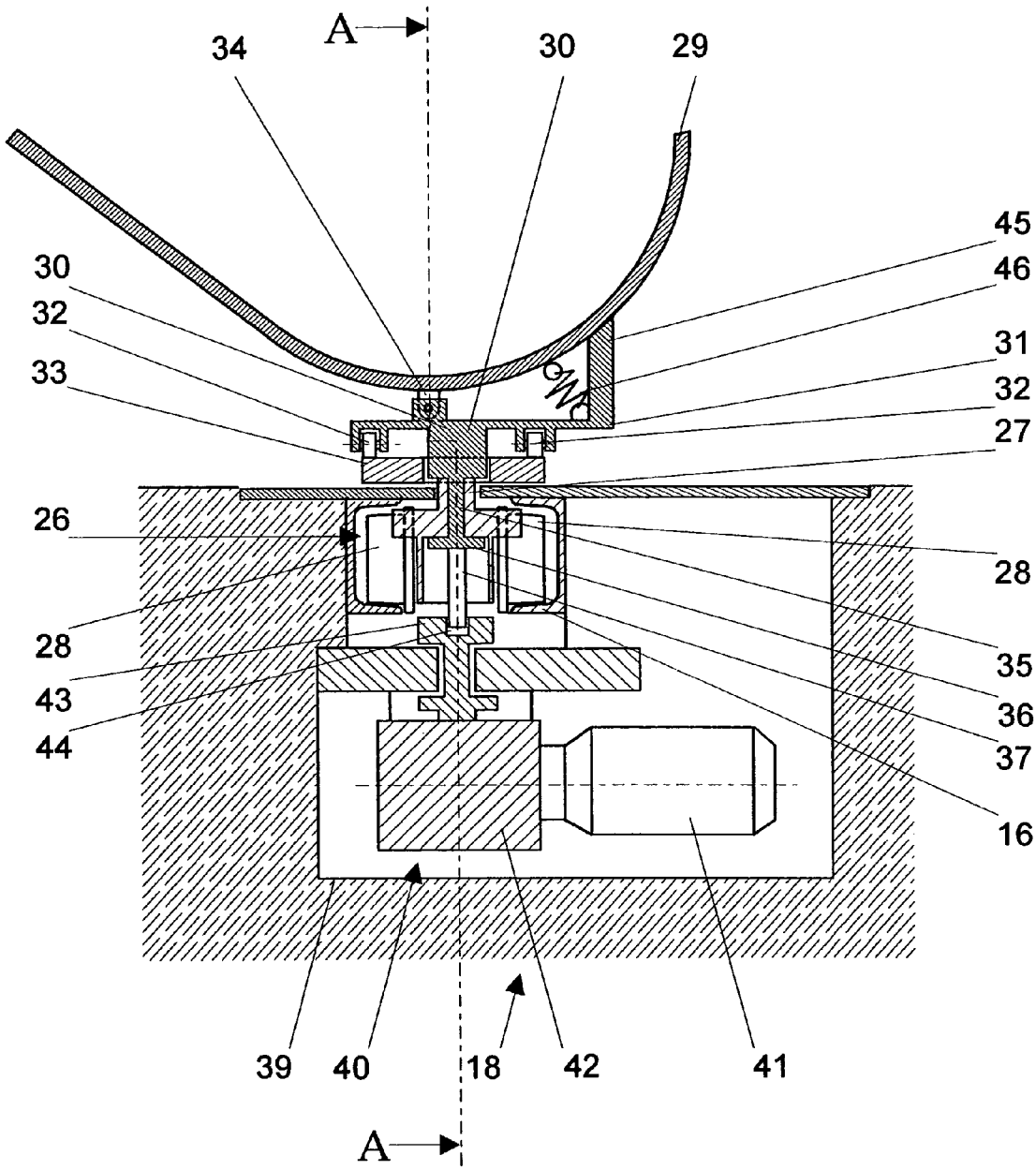
FIG. 4*b* shows a cross-section along B-B in FIG. 4*a*.
Figure 4C:
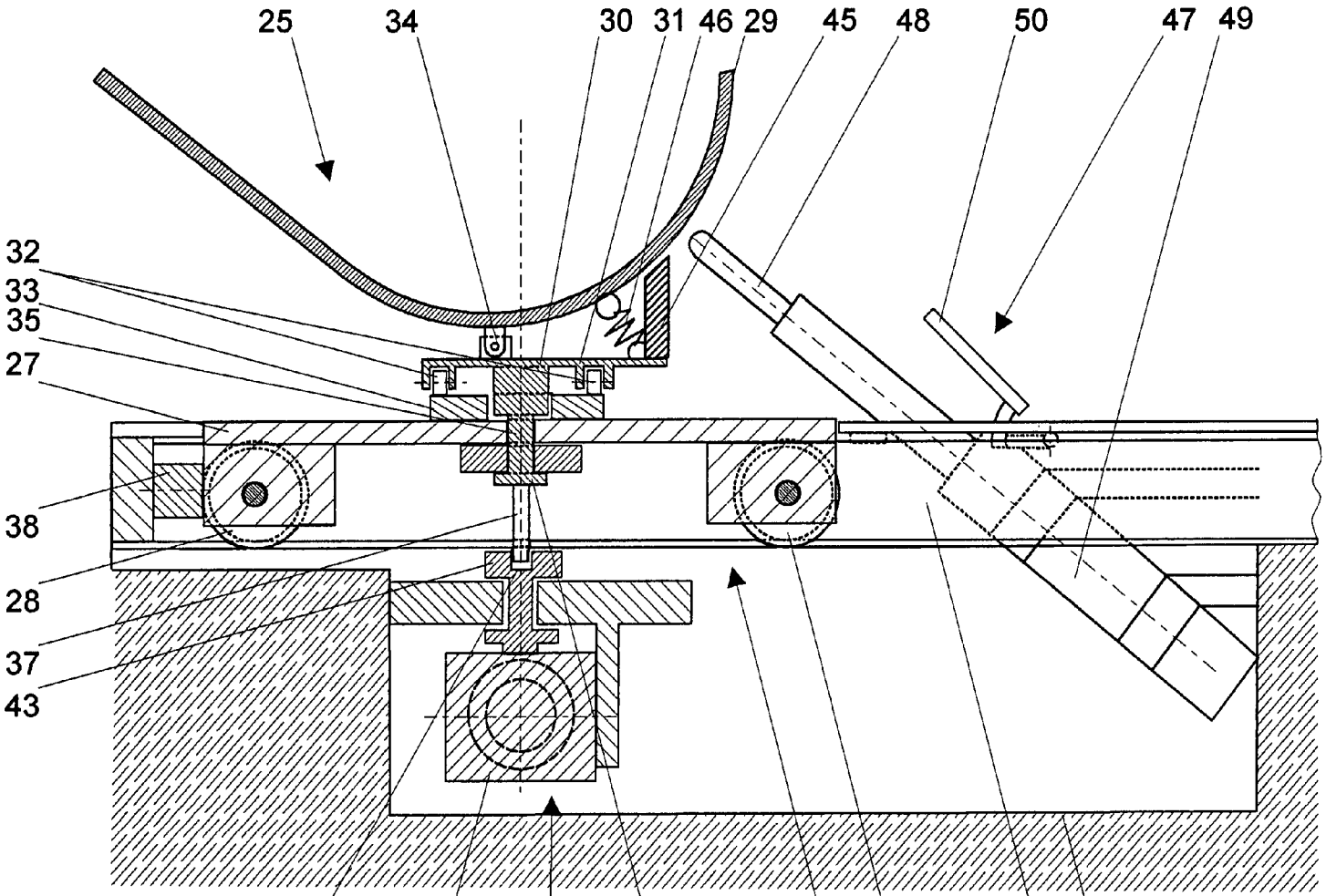
FIG. 4*c* shows a longitudinal section corresponding to FIG. 4*a* but with the reel core holder in an unloading position, FIG. 5*a* schematically shows a longitudinal section corresponding to FIG. 4*a*, the conveying means also being included, immediately before unloading of the reel core holder at the end of a reel core disposal.
Figure 5A:
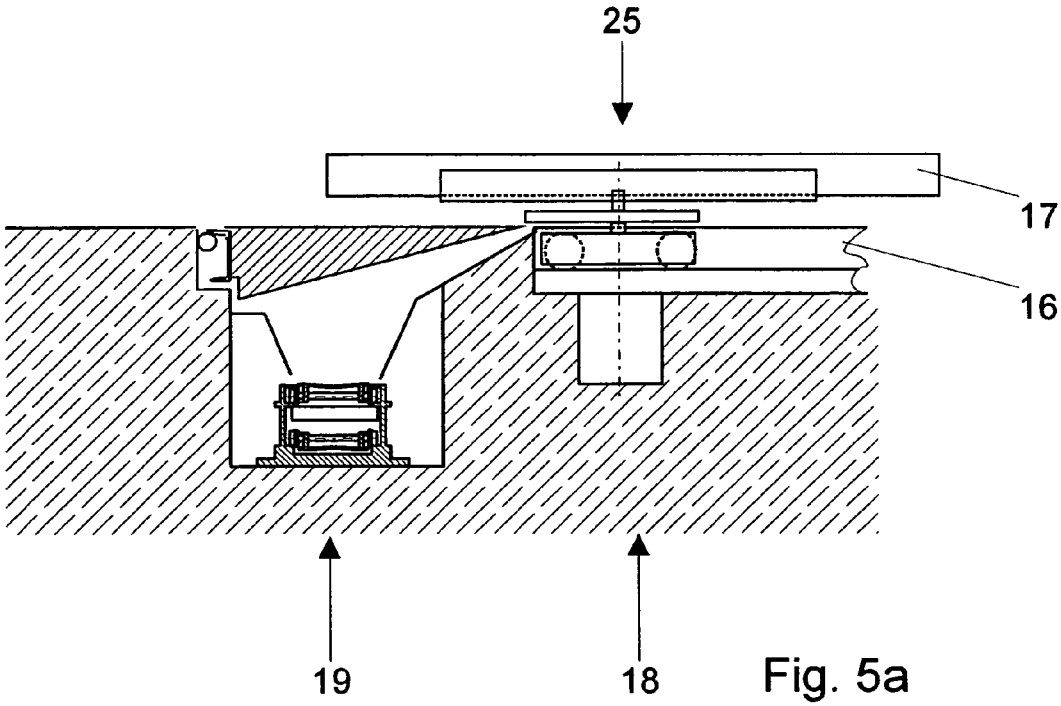
FIG. 5*b* shows a longitudinal section corresponding to FIG. 5*a*, after a first unloading step.
FIG. 5*c* shows a longitudinal section corresponding to FIG. 5*a*, after a second unloading step.
FIG. 5*d* shows a longitudinal section corresponding to FIG. 5*a*, after a third unloading step.
FIG. 5*e* shows a longitudinal section corresponding to FIG. 5*a*, after the unloading.
Figure 5B:
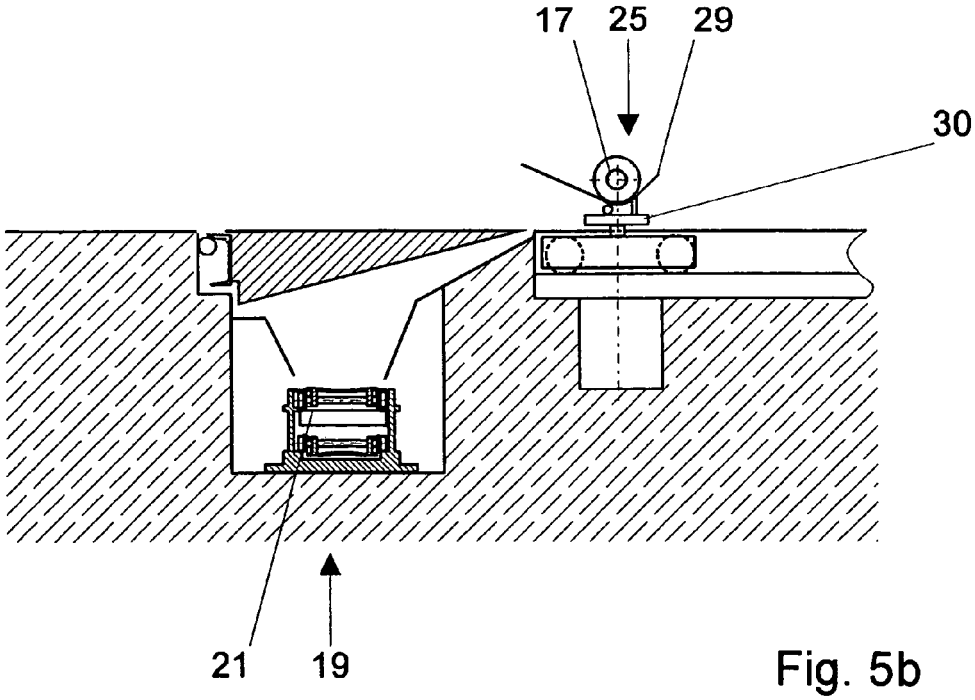

The moving platform 10 is then moved back into the transfer position, after which the reel core carriage 25 with the reel core 17 travels from the rail section 11 onto the transfer track 16 and along it to the delivery point 18, where it comes up against the buffer 38 (FIGS. 4*a*, 5*a*). Shortly before the reel core carriage 25 reaches the delivery point 18, the finger 37 reaches the end of the lever 43, aligned parallel to the transfer track 16 and inserts itself into the groove 44 by virtue of the fact that the carriage has covered the remaining distance to the delivery point 18. The lever 43 is then rotated through 90° by the motor 41 via the mitre gear 42, the finger 37 being carried along and thus the base 30 with the trough 29 likewise being rotated through 90°, so that the latter assumes an unloading position (FIGS. 4*b*, 5*b*) in which its longitudinal axis is parallel to the conveyor belt 21.

Figure 5C:
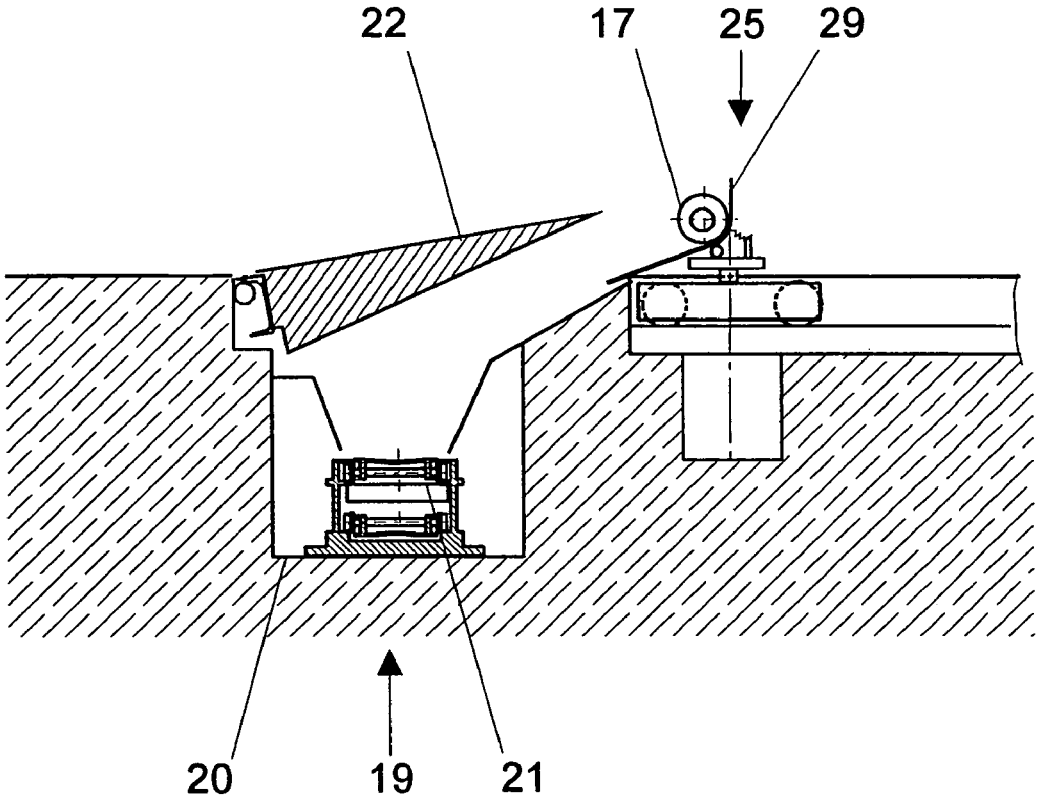
Figure 5D:
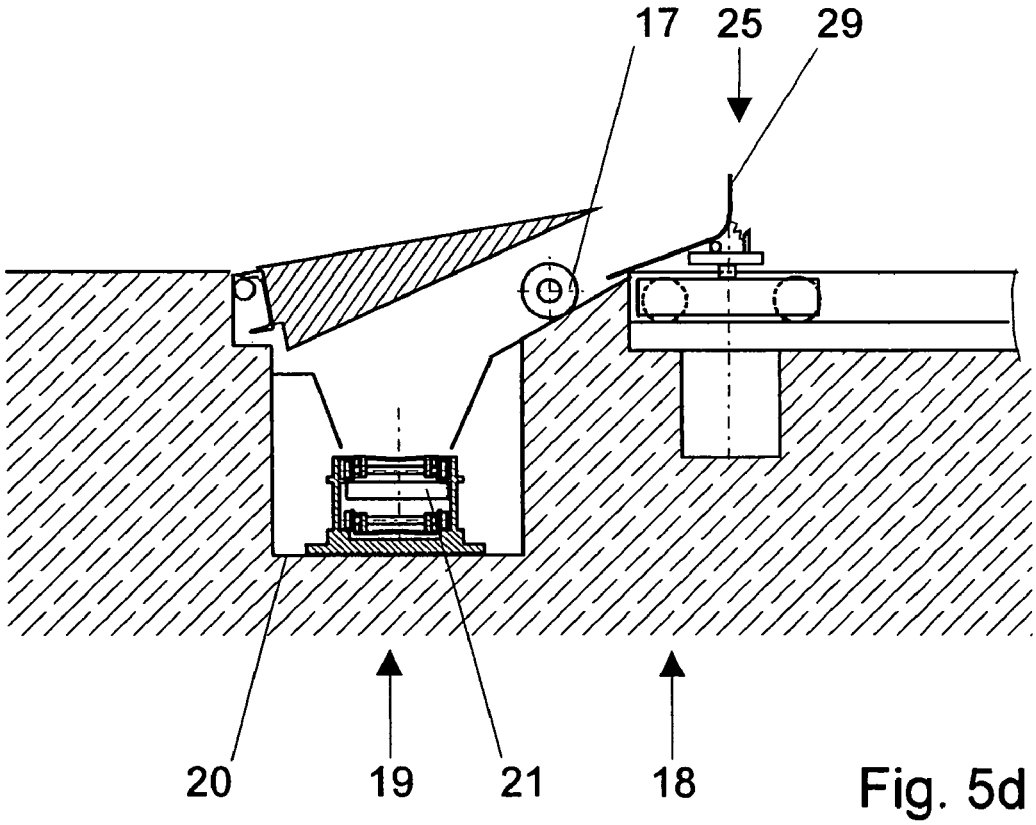
Figure 5E:
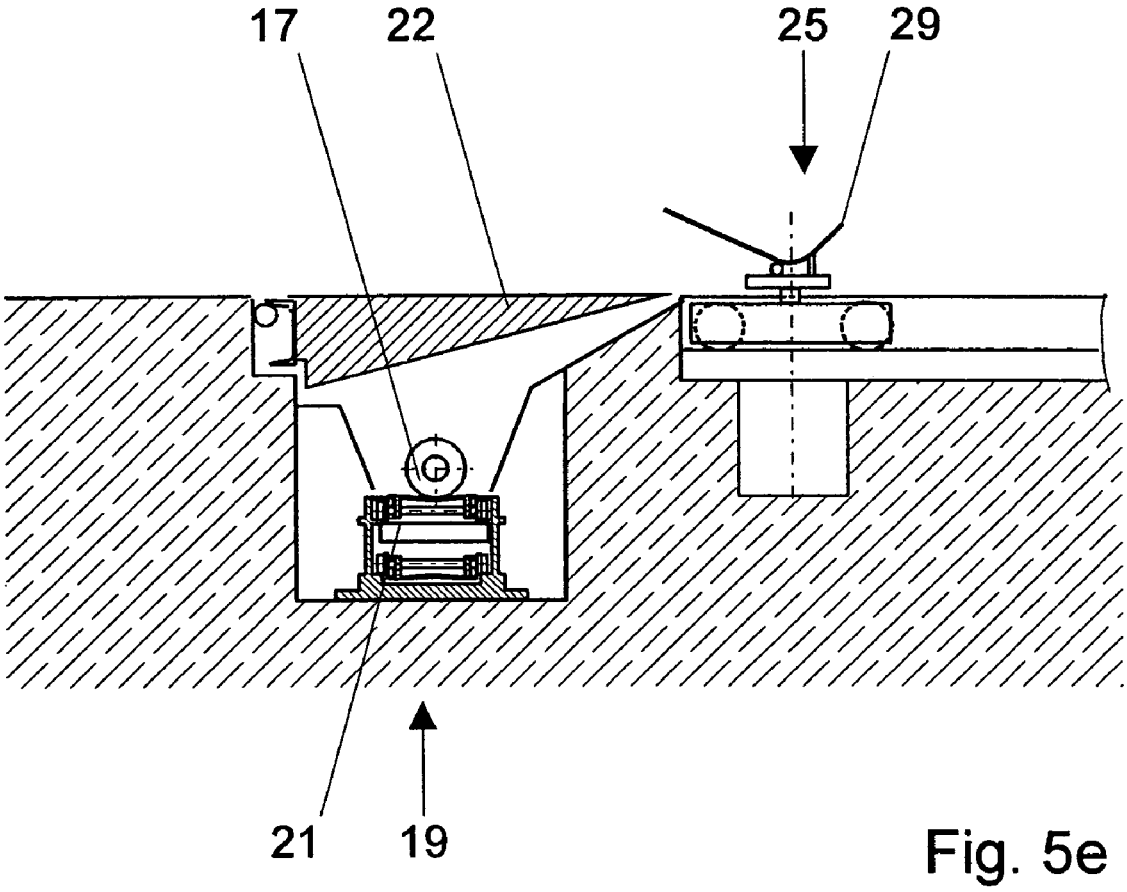

Thereafter, the cover 22 (FIG. 5*c*), which, adjacent to the delivery point 18, covers the conveyor belt 21 is swivelled up and the trough 29 is tilted towards the trench 20 about the axis defined by the hinge 34 by opening the hinged cover 50 and extending the ram 48 against the force of the tension spring 46 (cf. FIG. 4*c*), after which (FIG. 5*d*) the reel core 17 rolls from the trough 29 onto the conveyor belt 21 in the trench 20. The disposal system is controlled in such a way that overlapping of reel cores on the conveyor belt 21 is avoided. The cover 22 is then closed again and the ram 48 is retracted so that the trough 29 assumes its upright position again under the action of the tension spring 46 (FIG. 5*e*). The hinged cover 50 likewise closes. Finally, the base 30 with the trough 29 is rotated back through 90° so that the longitudinal direction of the latter is once again parallel to the transfer track 16 and the unwinding axes 9. The reel core carriage 25 is thus ready for further use, while the reel core 17 is conveyed by the conveyor belts 21, 21' (FIG. 3) into the reel core container 24 and is thus disposed of.

Various modifications of the transport system described are of course conceivable. Thus, the tilting of the trough could also be ensured by a suitable, for example wedge-like positive guide on the reel core carriage, which guide ensures that the trough performs a tilting movement during the last section of the rotational movement. Furthermore, the rotation of the base with the trough could be effected, for example, by guiding the finger along the last section of travel in a link which deflects it to one side. The carriage could in this case approach a waiting position located before the delivery point, and the approach to the delivery point with rotation of the base and tilting of the trough could be performed as a separate step later on.

It is also conceivable to provide, instead of a reel core carriage on a transfer track as a transfer means, a pivot arm having a trough which receives the reel core under the unwinding axis and is swivelled towards the delivery point and tilted by the pivot arm. The transfer means may also be arranged directly in the region of the reel stand, in which case the conveyor belt can pass through under the reel stands. However, the solution described has the advantage of substantial decoupling of the reel core disposal, so that the device parts serving the latter purpose can be easily combined with other parts of the conveying system and, in certain circumstances, can also be subsequently incorporated into an existing system.

Instead of a reel core container, another collecting means can be provided, for example, an unwinding device which removes any residual windings from the reel core before the latter is collected in a reel core container.

Figure 6:
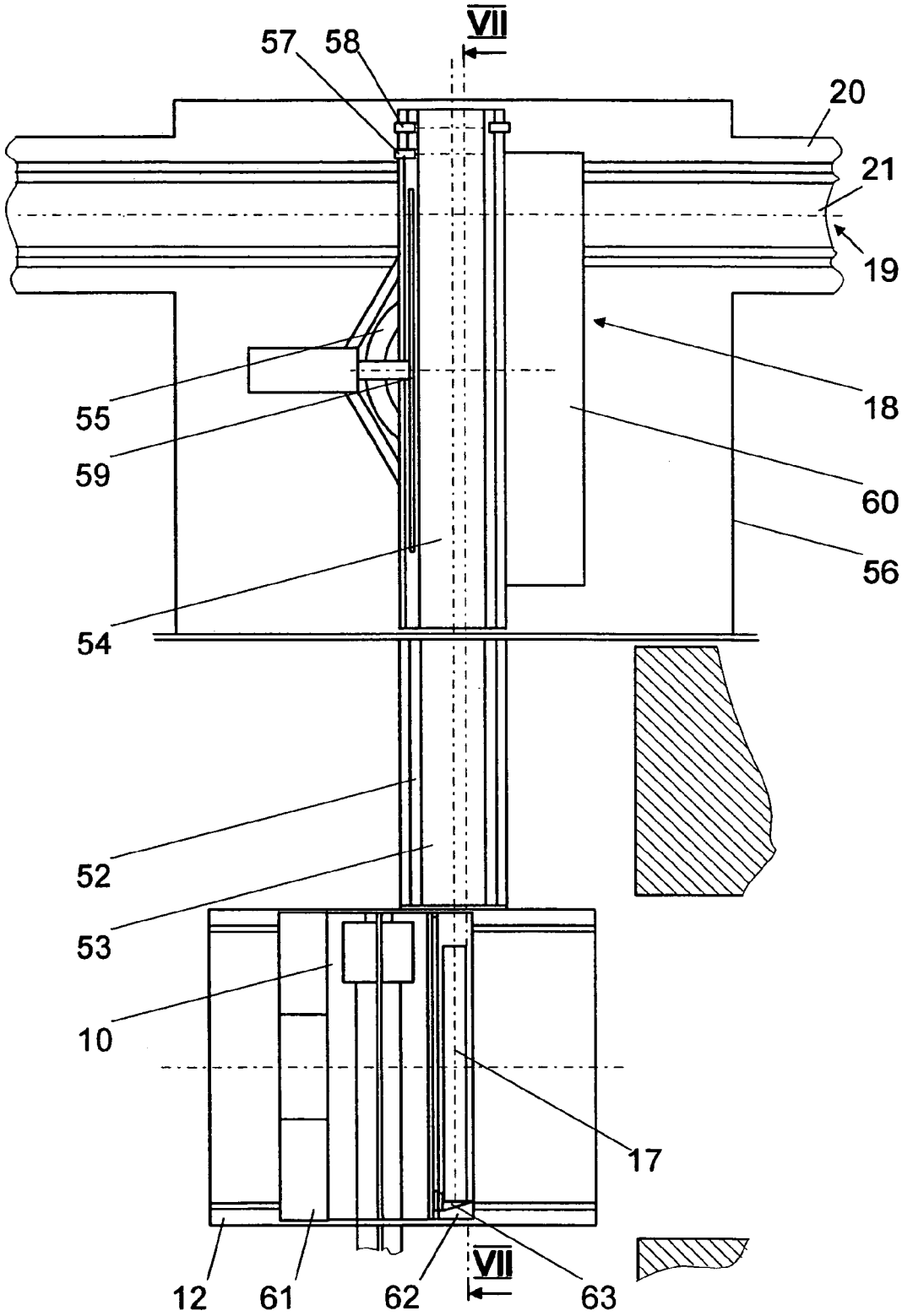
FIG. 6 shows a plan view of a part of a conveying system according to the invention, according to a second embodiment.
Figure 7:
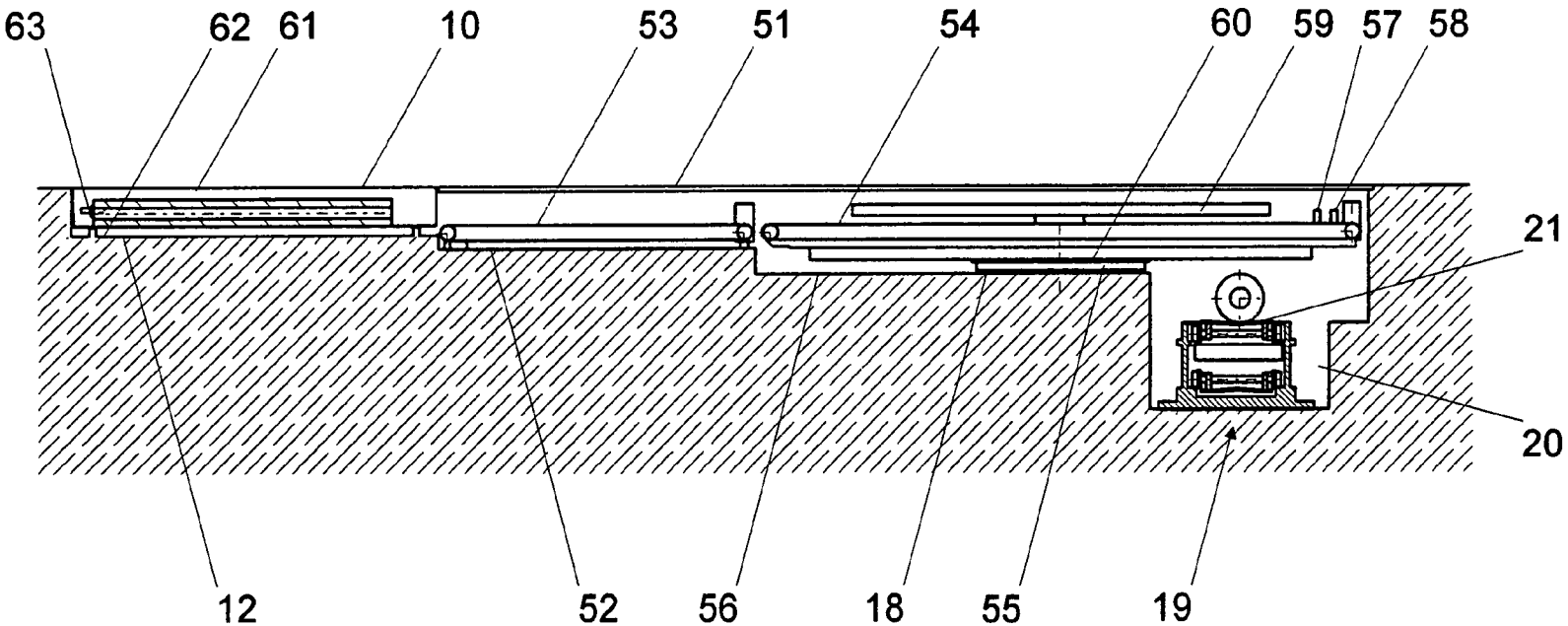
FIG. 7 shows a cross-section along VII-VII in FIG. 6.

According to a second embodiment of the conveying system otherwise substantially corresponding to that of the first embodiment, the transfer means is also arranged under the floor and is located under a cover 51 level with the floor (FIG. 7, omitted in FIGS. 6, 9*a-e*), so that the freedom of movement of persons is not limited by the disposal means. It comprises a transfer conveyor 53 which is arranged in a trench 52 and leads from the lateral edge of the pit 12 to a reel core holder which is in the form of a disposal conveyor 54 and is held on a pivot mounting 55 which is mounted at the delivery point 18 so as to be rotatable about a vertical axis, in the base of a rectangular pit 56. The transfer conveyor 53 and the disposal conveyor 54 are in the form of flat conveyor belts. Optical sensors 57, 58 are mounted, offset in the longitudinal direction, just before one end of the disposal conveyor 54. In a pick-up position shown in FIGS. 6, 7, the disposal conveyor is directly adjacent to the transfer conveyor 53 and projects, with the end section carrying the sensors 57, 58, beyond the conveying means 19. The length of the disposal conveyor 54 is substantially greater than that of the longest reel core to be expected. An unloading device likewise fastened to the pivot mounting 55 comprises a pusher 59 which can be moved forwards and backwards from the side over the disposal conveyor 54. At the opposite edge of the disposal conveyor 54, a ramp 60 which descends in an outward direction is likewise fastened to the pivot mounting 55.

The moving platform 10 is in the form of a displacement-elevating platform having an elevating table 61 which, in addition to the rail section 11, also carries, at its edge facing the reel stand 1, an elongated collecting device for the reel core 17. It comprises a tray 62 or a trough which extends over the width of the elevating table 61 and whose base is coated with a low-friction material, and a transfer device having a driver 63 which projects into the tray 62 and can be moved back and forth over the entire length thereof. The transfer device may comprise, for example, a drivable closed belt which carries the driver 63 or a rodless pneumatic piston.

Figure 8A:
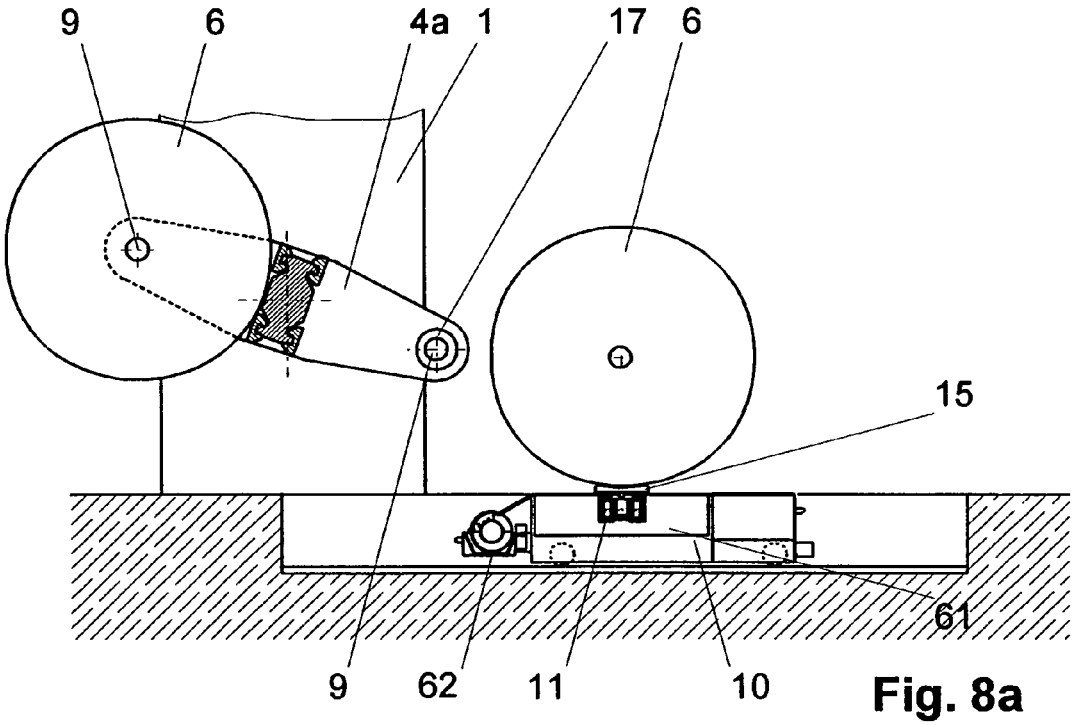
FIG. 8*a* shows a section through a reel stand immediately before a reel change.
Figure 8B:
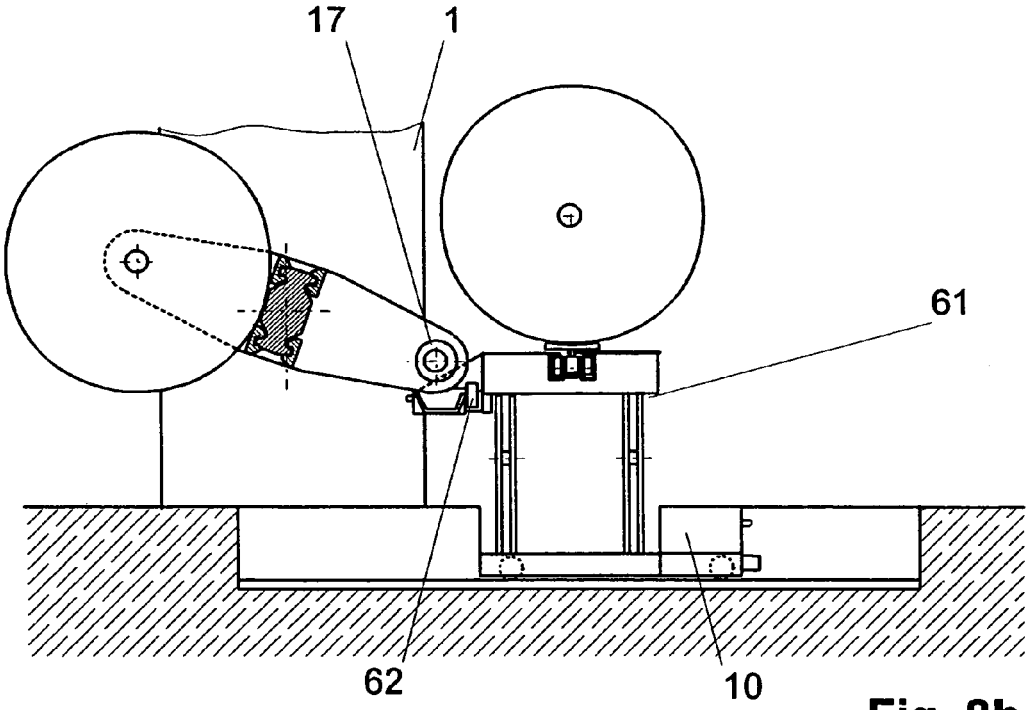
FIG. 8*b* shows a section corresponding to FIG. 8*a* in a first reel change step.
Figure 8C:
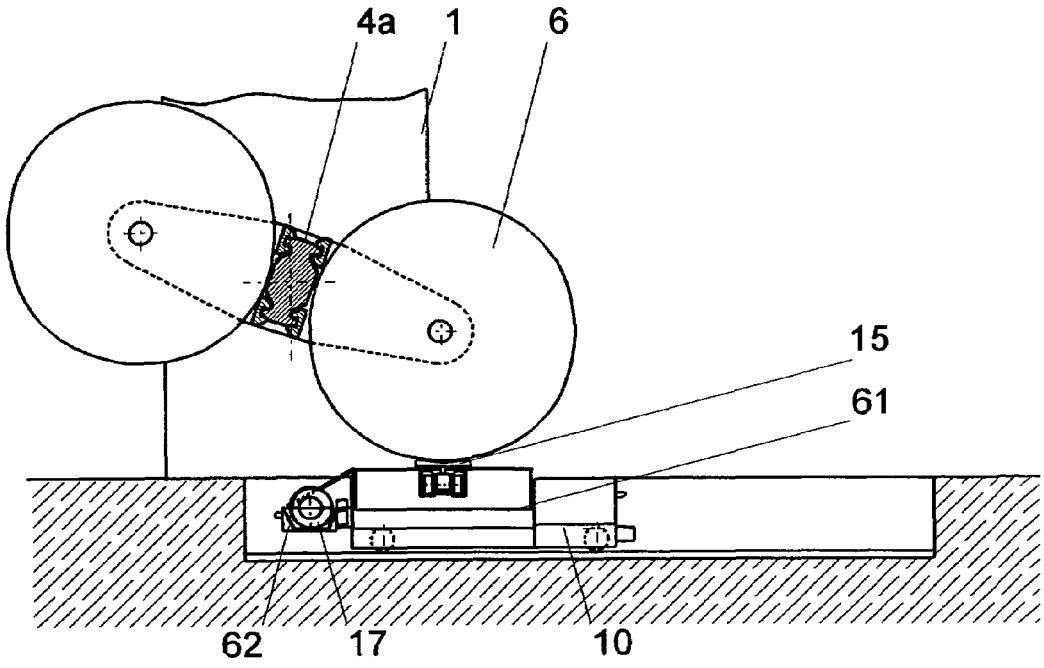
FIG. 8*c* shows a section corresponding to FIG. 8*a* after a second reel change step.
Figure 8D:
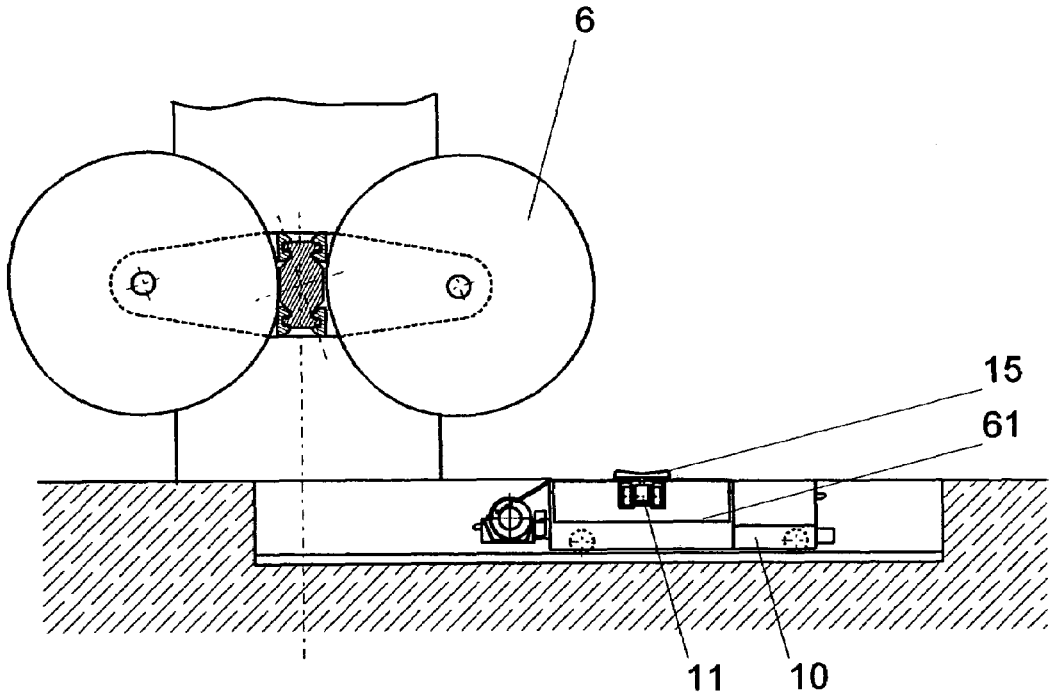
FIG. 8*d* shows a section corresponding to FIG. 8*a* after the reel change.

Before a reel change (cf. FIG. 8*a-d*, the reel stand has been omitted in FIGS. 6, 7, 9*a-e*), the moving platform 10 assumes the acceptance position in which a conveying carriage 15 loaded with a paper reel 6 travels onto the rail section 11 (FIG. 8*a*). It is then pushed towards the reel stand 1 until the tray 62 is under the unwinding axis 9 which carries the reel core 17, and then the elevating table 61 is raised from its starting position until the tray 62 is just below the reel core 17 (FIG. 8*b*) and the latter is ejected into the tray 62 without the risk of damage. This is important in particular when it is a reusable reel core. The elevating table 61 is then lowered again and the moving platform 10 is pushed further towards the reel stand 1 so that the paper reel 6 can be picked up by the arms 4*a,b* (FIG. 8*c*) and replaces the ejected reel core 17. After the reel change, the paper reel 6 is lifted by the conveying carriage 15, the elevating table 61 is lowered into the starting position and the moving platform 10 is pushed back into the acceptance position (FIG. 8*d*) so that the conveying carriage 15 can change from the rail section 11 to the loading track 14.

Figure 9A:
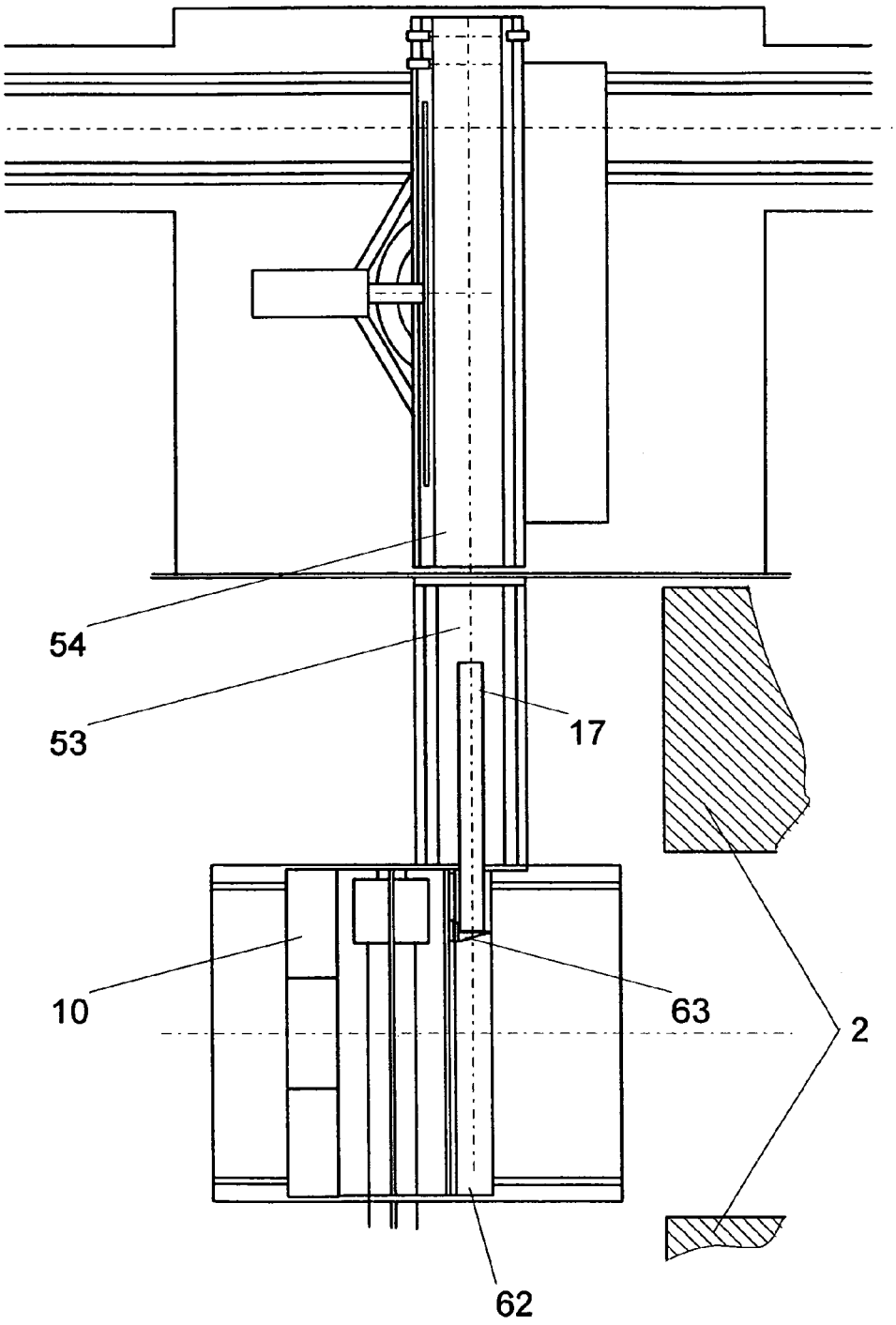
FIG. 9*a* shows a plan view corresponding to FIG. 6 in a first step of a reel core disposal.
Figure 9B:
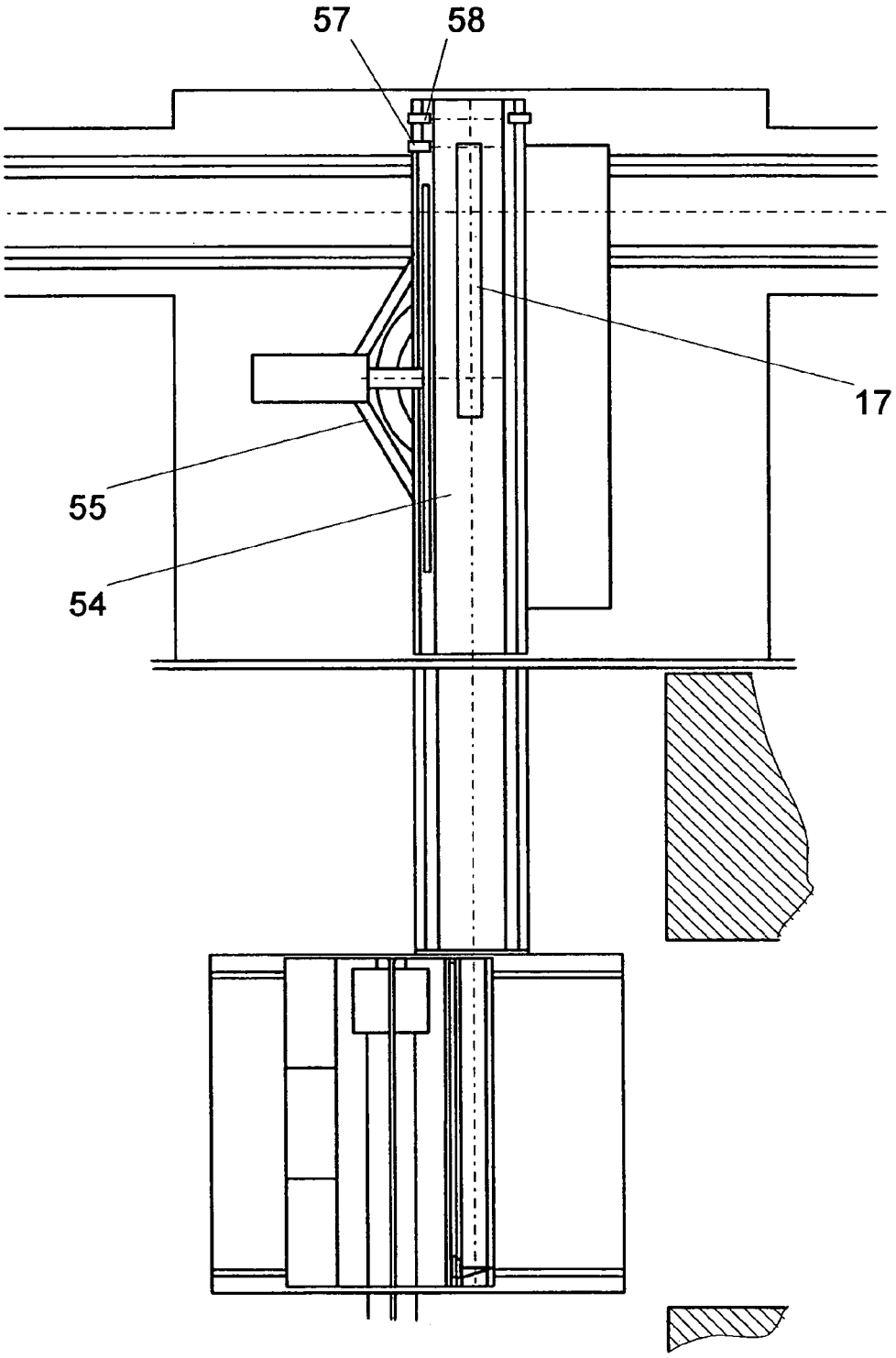
FIG. 9*b* shows a plan view corresponding to FIG. 9*a* after a second step of reel core disposal.

The moving platform 10 then assumes a transfer position which preferably once again corresponds to the acceptance position or is otherwise approached, in which the collecting device, in particular the tray 62 thereof, is flush with the transfer conveyor 53. For reel core disposal, the reel core 17 is then pushed (FIG. 9*a*) by the driver 63 of the transfer device onto the transfer conveyor 53, which is simultaneously set into motion, and is further transported by it onto the disposal conveyor 54, which is likewise set into motion and assumes its pick-up position. When the front end of the reel core 17 reaches a certain position in the vicinity of the end of the disposal conveyor 54, this is detected by the sensor 57 and the disposal conveyor 54 is stopped (FIG. 9*b*). The sensor 58 is redundant. It responds if the sensor 57 fails for any reason, and then causes the disposal conveyor 54 to stop.

Figure 9C:
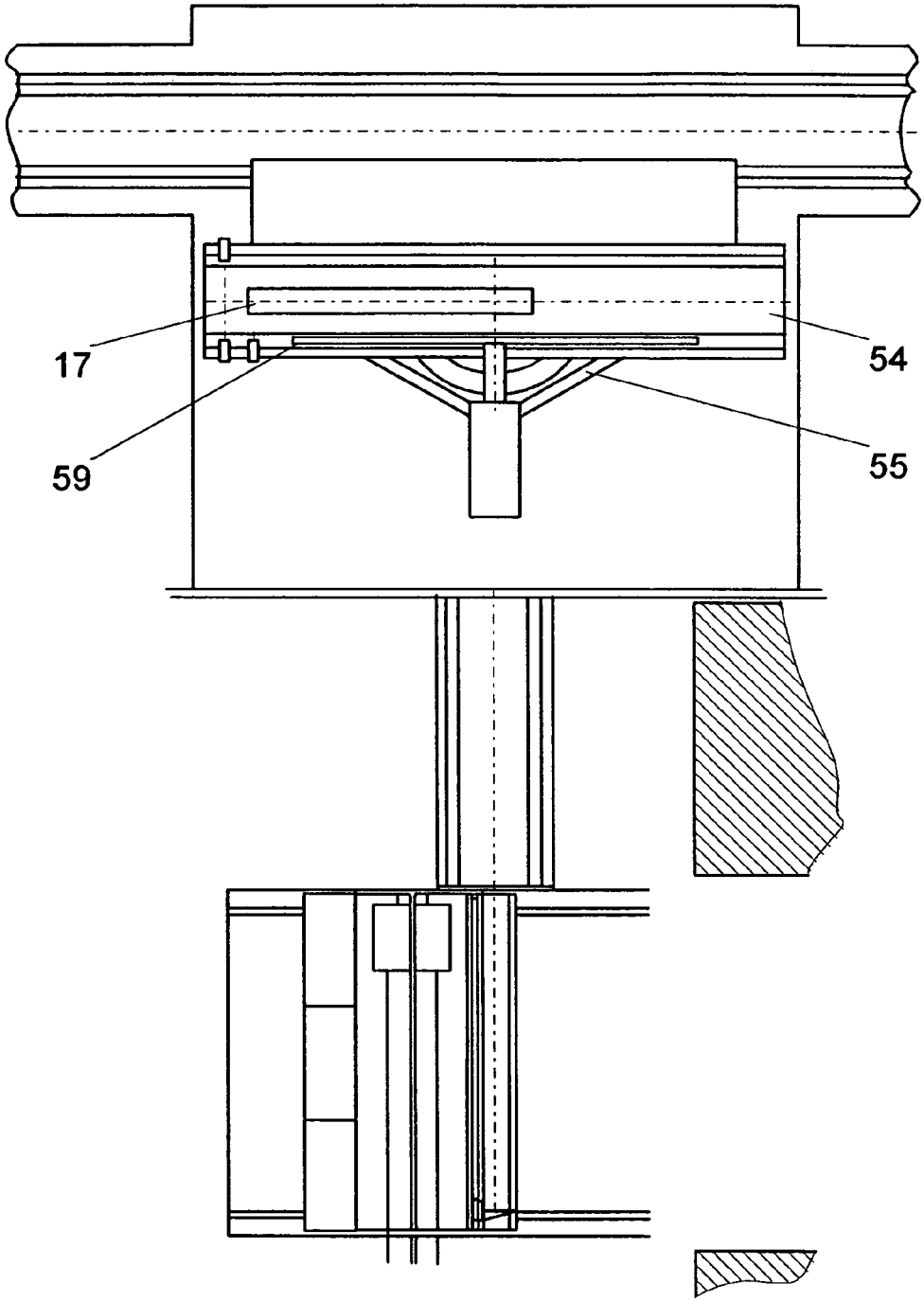
FIG. 9*c* shows a plan view corresponding to FIG. 9*a* after a third step of reel core disposal.
Figure 9D:
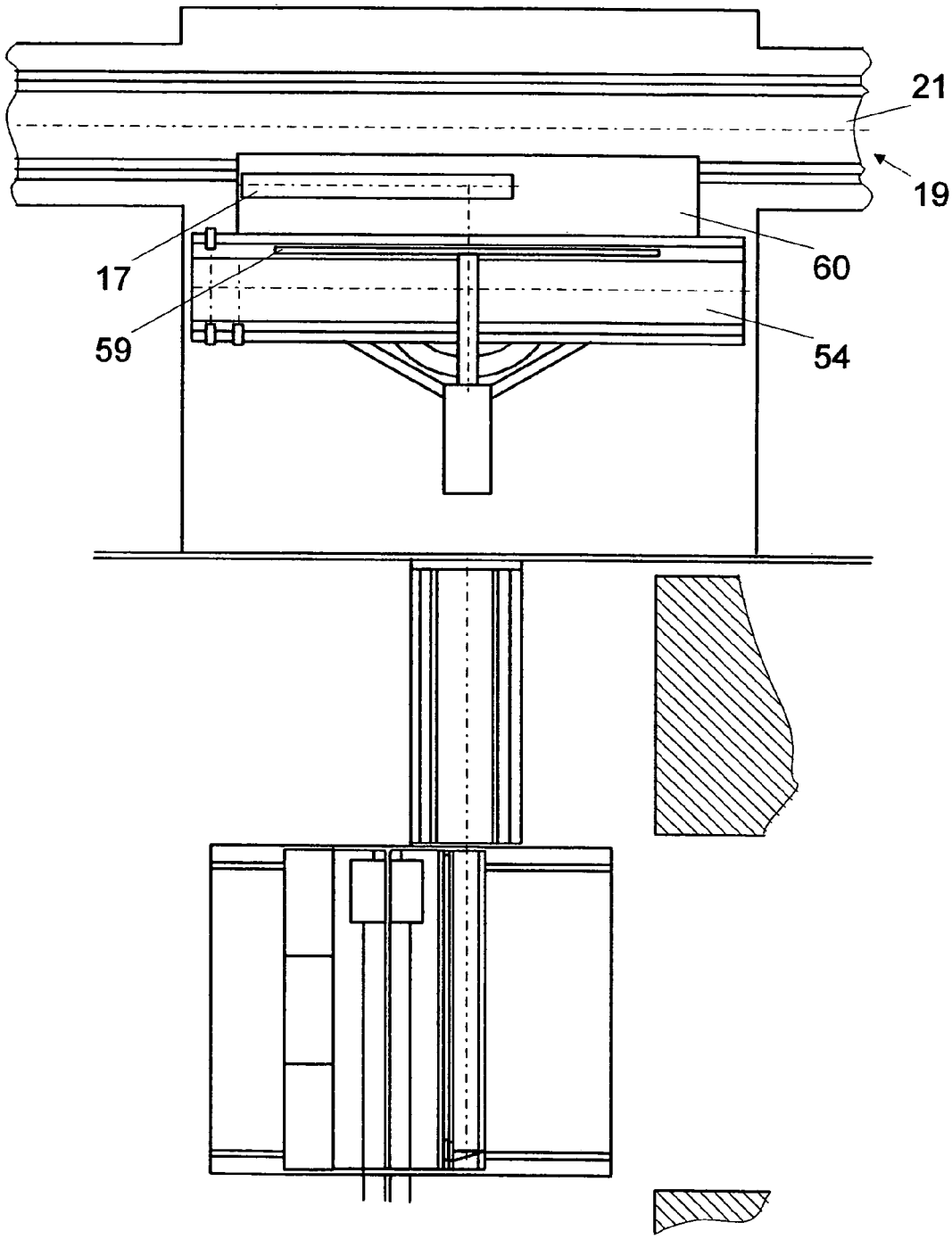
FIG. 9*d* shows a plan view corresponding to FIG. 9*a* in the unloading of the reel core holder as a fourth step of reel core disposal.
Figure 9E:
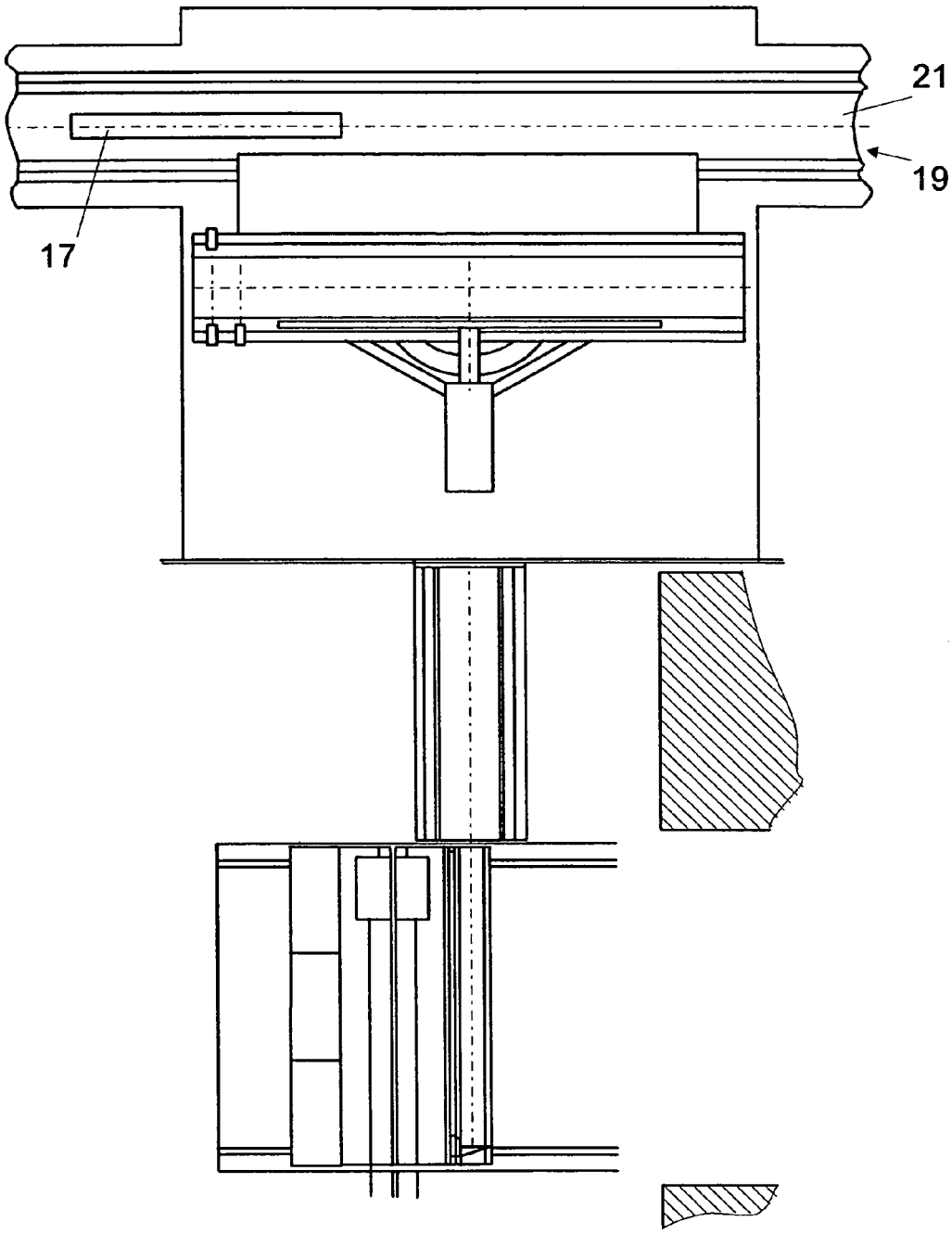
FIG. 9*e* shows a plan view corresponding to FIG. 9*a* after the unloading.

Finally, the pivot mounting 55 with the disposal conveyor 54 is rotated through 90° so that the latter assumes its unloading position (FIG. 9*c*). Thereafter, the pusher 59 is moved forwards and pushes the reel core 17 off the disposal conveyor 54 so that it rolls over the ramp 60 (FIG. 9*d*) onto the conveyor belt 21 of conveying means 19 and is further transported by said conveying means (FIG. 9*e*) to the reel core container 24 (FIG. 3) or some other collecting means.

Here too, numerous modifications are of course possible. Thus, the moving platform need not be in the form of a displacement-elevating platform, especially if the reel cores are not to be reused and it can therefore be accepted that they will be damaged on ejection. The collecting device may also be in the form of a flat conveyor belt accompanied on both sides by side walls. Conversely, the transfer conveyor and the disposal conveyor may be in the form of trays having a low-friction coating, like the collecting device described, and having lateral conveyors or the like, which carry at least one driver which, for example, can be swivelled in against spring force and pushes the reel core over the conveyor. The disposal conveyor may be tiltable, in which case the pusher can be omitted.

The disposal conveyor whose design is arbitrary otherwise may as well be stationary and describe a quadrant at the end which leads to a straight end section which is parallel to the conveyor belt of the conveying means and is located beside or above the conveyor belt so that the core is turned and then pushed by a stationary pusher onto the conveyor belt or tilts towards the latter and then falls down on it. Also conceivable is a rotation of the core by passive means in the case of a straight stationary disposal conveyor, for example a smooth guide wall which describes a quadrant and runs transversely over the end section of the disposal conveyor to the opposite edge of the conveyor belt of the conveying means so that, when the front end of the core abuts the guide wall, the core is turned and tilts over the lateral edge of the disposal conveyor onto the conveyor belt and is picked up by the latter. The friction between the core on the one hand and the disposal conveyor and the conveyor belt on the other hand should be relatively great for this purpose, in any case substantially greater than that between the core and the guide wall. If required, the transfer of the core onto the conveyor belt can be supported by a stationary pusher. In the case of the last-described solutions, the disposal conveyor may also extend further back so that the separate transfer conveyor is unnecessary.

Finally, the disposal means may also be located on the feed side, in which case it must of course be formed and arranged in such a way that no collisions with the feed means occur; in particular, the conveying means must be led under the loading tracks.

The reel core disposal can be controlled by a host computer of the entire system. It is advantageous if the control is effected in such a way that the reel core holders of all transfer means which currently have reel cores to dispose of each simultaneously transfer their reel cores to the conveying means 19 and, between such transfers, in each case the conveyor belts 21, 21' run at least until a reel core has been conveyed from that delivery point which is furthest away from the reel core container 24 beyond that delivery point which is closest to said reel core container, since overlaps of reel cores on the conveying means 19, which might lead to faults, is thus reliably avoided without a major control effort.

List of reference symbols

| | |
|---|---|
| 1, 1a, b, c | Reel stand |
| 2 | Portal |
| 3 | Axle |
| 4a, b | Arms |
| 5 | Cones |
| 6 | Paper reel |
| 7 | Paper web |
| 8 | Guide roller |
| 9 | Unwinding axis |
| 10 | Moving platform |
| 11 | Rail section |
| 12 | Pit |
| 13 | Light barrier |
| 14 | Loading track |
| 15 | Conveying carriage |
| 16 | Transfer track |
| 17 | Reel core |
| 18 | Delivery point |
| 19 | Conveying means |
| 20 | Trench |
| 21, 21' | Conveyor belt |
| 22 | Cover |
| 23 | Wall |
| 24 | Reel core container |
| 25 | Reel core carriage |

-continued

| List of reference symbols | |
|---|---|
| 26 | Chassis |
| 27 | Baseplate |
| 28 | Wheel |
| 29 | Trough |
| 30 | Base |
| 31 | Carrier |
| 32 | Support rollers |
| 33 | Plate |
| 34 | Hinge |
| 35 | Axle |
| 36 | Lever |
| 37 | Finger |
| 38 | Buffer |
| 39 | Pit |
| 40 | Rotary device |
| 41 | Motor |
| 42 | Mitre gear |
| 43 | Drive lever |
| 44 | Longitudinal groove |
| 45 | Support |
| 46 | Tension spring |
| 47 | Tilting device |
| 48 | Ram |
| 49 | Longitudinal guide |
| 50 | Hinged cover |
| 51 | Cover |
| 52 | Trench |
| 53 | Transfer conveyor |
| 54 | Disposal conveyor |
| 55 | Pivot mounting |
| 56 | Pit |
| 57, 58 | Sensors |
| 59 | Pusher |
| 60 | Ramp |
| 61 | Elevating table |
| 62 | Tray |
| 63 | Driver |

The invention claimed is:

1. A conveying system for supplying a plurality of reel stands, which are arranged in a row and in each case have at least two unwinding axes aligned transversely to the row, with paper reels, the system comprising:

a feed means for feeding the paper reels to the reel stands;

a disposal means for disposing of reel cores, having a continuous conveying means running under the floor and for conveying the reel cores entirely under the floor in a conveying direction parallel to the row of the reel stands; and for each reel stand, a transfer means for transferring the reel cores from the reel stand to the conveying means with rotation of the reel cores from an orientation parallel to the unwinding axes of the reel stand to an orientation parallel to the conveying direction of the conveying means.

2. The conveying system according to claim 1, wherein the feed means is arranged on a feed side and the conveying means on a removal side of the row of reel stands which is opposite the feed side.

3. The conveying system according to claim 1, wherein in each case a moving platform displaceable transversely to the unwinding axes up to below said axes is coordinated with each reel stand and has a track section parallel to the unwinding axes.

4. The conveying system according to claim 3, wherein the feed means for each reel stand has a loading track which is parallel to the unwinding axes and leads from the feed side to the moving platform, where it is flush with the track section when the moving platform is in an acceptance position, and conveying carriages for paper reels which can travel on the loading tracks.

5. The conveying system according to claim 4, wherein the loading track is flush with a transfer track which connects the moving platform to a delivery point so that the acceptance position of the moving platform corresponds to the transfer position thereof.

6. The conveying system according to claim 3, wherein the transfer means comprises in each case a transfer track which connects the moving platform to a delivery point directly at the conveying means and with which the track section is flush when the moving platform is in a transfer position, and a reel core carriage which comprises the reel core holder and a chassis which can travel on the transfer track and the track section and on which the reel core holder is mounted so as to be rotatable about a vertical axis.

7. The conveying system according to claim 3, wherein the transfer conveyor starts from a lateral edge of the moving platform and the latter carries an elongated collecting device which is parallel to the unwinding axes and is intended for receiving a reel core and which is flush with the transfer conveyor when the moving platform is in a transfer position and is suitable for transfer of the reel core to said conveyor.

8. The conveying system according to claim 7, wherein the collecting device comprises a tray and a transfer device having a driver projecting into the tray and displaceable along said tray.

9. The conveying system according to claim 7, wherein the moving platform is in the form of a displacement-elevating platform and the collecting device is fastened thereto in such a way that it is also carried along during vertical movements.

10. The conveying system according to claim 1, wherein the conveying means comprises at least one conveyor belt or a roller conveyor.

11. The conveying system according to claim 1, further comprising a collecting means including a reel core container or an unwinding device, which is arranged at one end of the conveying means.

12. The conveying system according to claim 11, wherein the collecting means is arranged above-ground and the conveying means has an end section which ascends above floor level and projects laterally over the collecting means.

13. The conveying system according to claim 1, wherein the transfer means for each reel stand comprises in each case an elongated reel core holder for holding a reel core in such a way that the latter rests on it substantially over its entire length, which reel core holder can be changed between a pick-up position, in which its longitudinal direction is parallel to the unwinding axes, and an unloading position in which its longitudinal direction is parallel to the conveying direction.

14. The conveying system according to claim 13, wherein the reel core holder, at least in the unloading position, is located at a delivery point directly at the conveying means.

15. The conveying system according to claim 14, wherein an unloading device for unloading the reel core holder is arranged at each delivery point.

16. The conveying system according to claim 15, wherein the unloading device comprises a pusher which can be moved forwards over the reel core holder when said unloading device is in an unloading position.

17. The conveying system according to claim 14, wherein the reel core holder in the pick-up position is present under one of the unwinding axes and can be moved to the delivery point.

18. The conveying system according to claim 17, wherein the unloading device comprises a rotary device for changing over the reel core holder from the pick-up position to the unloading position.

19. The conveying system according to claim 17, wherein the unloading device comprises a tilting device.

20. The conveying system according to claim 14, wherein the reel core holder is arranged stationary at the delivery point so as to be rotatable about a vertical axis.

21. The conveying system according to claim 20, wherein the reel core holder is in the form of a disposal conveyor which, in the pick-up position, is adjacent to the transfer conveyor.

22. The conveying system according to claim 13, wherein the reel core holder is tiltable about an axis parallel to the longitudinal direction thereof.

23. The conveying system according to claim 1, wherein each transfer means comprises a transfer conveyor which is arranged under the floor and runs parallel to the unwinding axes from the reel stand towards the conveying means.

24. A method for operating the conveying system according to claim 1, wherein the disposal is effected in such a way that the reel cores to be disposed of in each case are brought from the reel stands by the transfer means to the conveying means and at the same time are transferred to said conveying means.

25. A conveying system for supplying a plurality of reel stands, which are arranged in a row and in each case have at least two unwinding axes aligned transversely to the row, with paper reels, the system comprising:

a feed means for feeding the paper reels to the reel stands;

a disposal means for disposing of reel cores, having a continuous conveying means running under the floor and intended for conveying the reel cores in a conveying direction parallel to the row of the reel stands; and for each reel stand, a transfer means for transferring reel cores from the reel stand to the conveying means with rotation thereof from an orientation parallel to the unwinding axes of the reel stand to an orientation parallel to the conveying direction of the conveying means, wherein the conveying means is arranged in a covered trench.

* * * * *